United States Patent [19]

Krasij et al.

[11] Patent Number: 4,623,861

[45] Date of Patent: Nov. 18, 1986

[54] ROCKER ACTUATOR BRACKET ASSEMBLY FOR A SPLIT CASE CIRCUIT BREAKER

[75] Inventors: Bohdan Krasij, Avon; Charles Mune, West Hartford, both of Conn.

[73] Assignee: Carlingswitch, Inc., West Hartford, Conn.

[21] Appl. No.: 782,470

[22] Filed: Oct. 1, 1985

[51] Int. Cl.[4] ..... H01H 9/02; H01H 13/04

[52] U.S. Cl. ..... 335/202; 200/303; 200/339; 337/66; 337/79

[58] Field of Search ..... 335/121, 186, 202; 200/339, 303, 307; 337/66, 79

[56] References Cited

U.S. PATENT DOCUMENTS 3,444,345 5/1969 Mackiewicz ..... 200/303

4,168,480 9/1979 De Lucia ..... 335/202

4,242,551 12/1980 Sorenson ..... 200/339

4,347,488 8/1982 Mune et al. ..... 335/8

*Primary Examiner*—E. A. Goldberg

*Assistant Examiner*—Lincoln Donovan

*Attorney, Agent, or Firm*—McCormick, Paulding & Huber

[57] ABSTRACT

A split case circuit breaker is fitted with a bracket assembly which defines a rectangular boss to cover the smaller circuit breaker boss on the front face of the breaker housing. An actuator link operates the otherwise conventional breaker mechanism inside the housing, and has a free end portion coupled to a rocker pivotably provided in a rectangular recess defined for it in the rectangular boss of the bracket assembly.

3 Claims, 5 Drawing Figures

ROCKER ACTUATOR BRACKET ASSEMBLY FOR A SPLIT CASE CIRCUIT BREAKER

This invention relates generally to magnetic circuit breakers of the type having a split case configuration, and that are normally operated by a toggle projecting through the front face of the housing. More particularly, this invention relates to a rocker actuator bracket assembly serving the dual function of securing the breaker housing in an oversized rectangular panel opening, and also providing a replacement for the toggle in the form of a rocker style circuit breaker operator.

The general object of the present invention is to provide an actuator bracket assembly for a split case circuit breaker such that the breaker can be fitted in a larger rectangular size panel opening than that possible with the split case configuration, and so that the circuit breaker can be manually actuated or reset by means of a rocker rather than a toggle.

In its presently preferred form the actuator bracket assembly is adapted to be secured to the front face of a conventional split case magnetic circuit breaker and to define two threaded openings in the front face of the bracket assembly such that conventionally spaced mounting screws can be received therein. The circuit breaker housing has opposed end faces and a front face with a raised boss provided on the latter to fit into a relatively small panel opening. This boss itself defines a slot in which is normally provided the toggle for actuating the breaker. The breaker includes a conventional magnetic circuit breaker mechanism that includes a pivoted actuator link in place of the toggle, and said link has a free end portion provided in the slot but does not project externally of said slot. A cross pin is provided in the actuator link free end portion. The bracket assembly includes a U-shaped adapter plate of one-piece plastic with a resiliently formed leg portion at one end and an opposite leg portion which cooperates with the resilient leg portion to define a rearwardly open recess for receiving the breaker front face as a result of bending of the resilient leg portion. These leg portions define inturned lips for entry in openings provided therefor in the circuit breaker end faces. The adapter plate defines a generally rectangular outer boss sized to fit a larger panel opening than that adapted to accommodate the raised boss on the breaker front face. The plate defines a generally rectangular recess inside this rectangular boss and a rocker is pivotally mounted in the recess by means of axle defining portions on the rocker received in aligned openings provided for them in the rectangular recess defining boss. The rocker has a depending yoke also integrally formed therein, and the yoke has laterally spaced legs that define slots to receive the cross pin in order to provide pivotal motion of the rocker, opposite but corresponding to that of the actuator link in the breaker.

DETAILED DESCRIPTION

Figure 1:
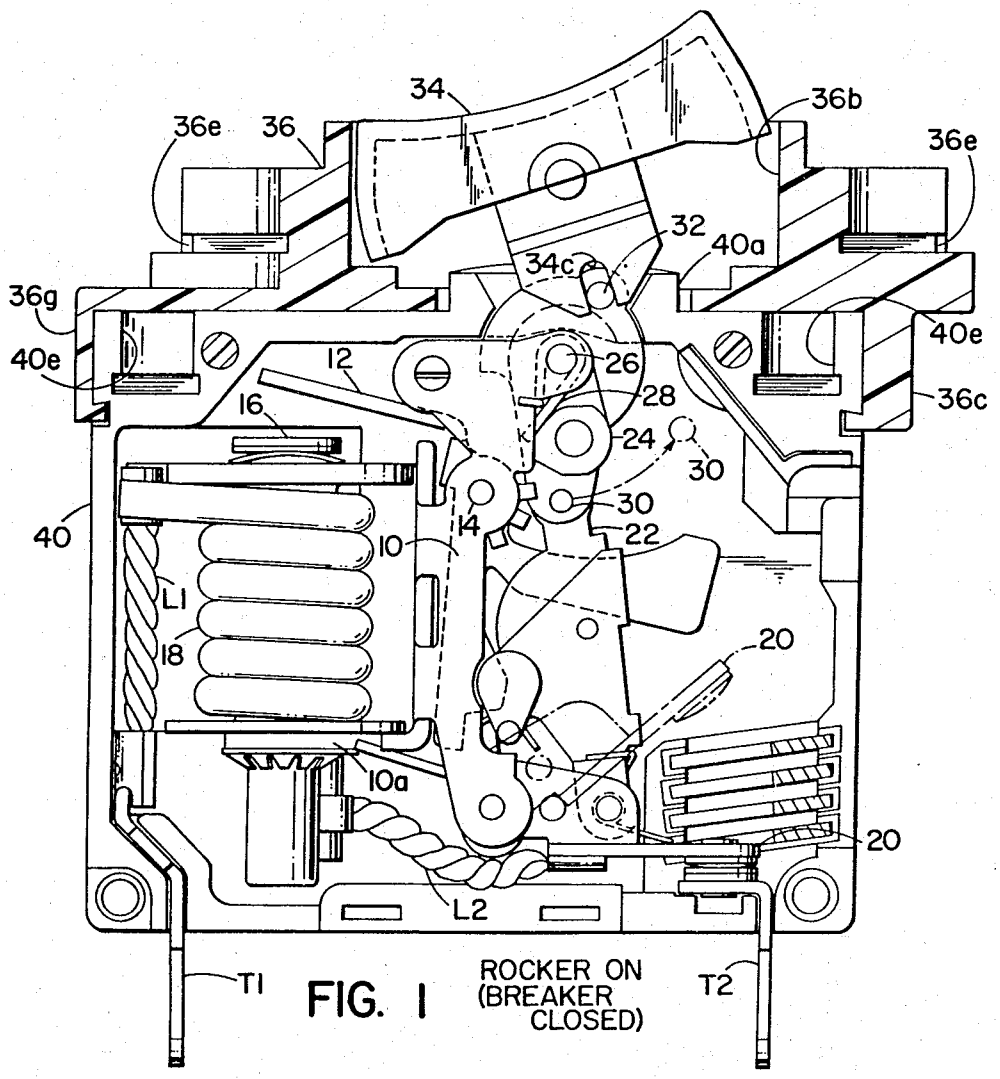
FIG. 1 is an elevational view with portions of the circuit breaker case broken away illustrating a conventional split case magnetic circuit breaker fitted with a rocker bracket assembly in accordance with the present invention. A portion of the breaker mechanism is illustrated in full and other portions thereof are depicted schematically in this view.

Turning now to the drawings in greater detail, FIG. 1 illustrates a magnetic circuit breaker of the type adapted to being fitted with a bracket assembly of the present invention. The conventional elements of a split case magnetic breaker are described in some detail in our prior issued Pat. No. 4,347,488 entitled "Multi-Pole Circuit Breaker" issued Aug. 31, 1982 and assigned to the assignee herein.

Figure 2:
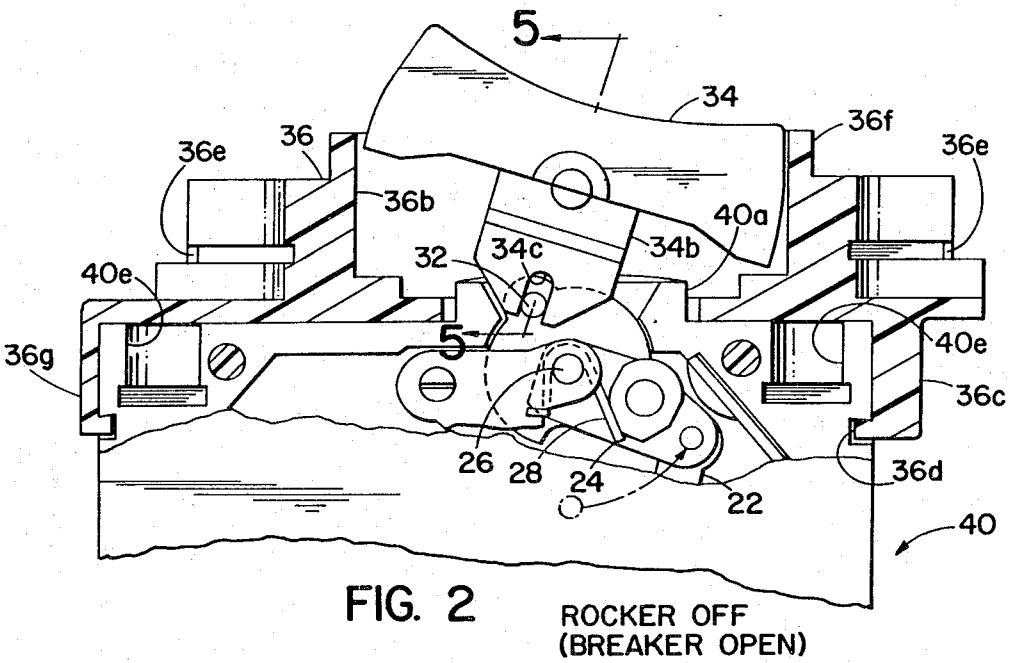
FIG. 2 is a view similar to FIG. 1 but illustrating only the upper end portion of the circuit breaker housing, and also illustrating the rocker in an alternative position corresponding to that of the circuit breaker when the contacts are open.

FIG. 1 illustrates a single pole circuit breaker of this general type, and such a breaker generally includes a magnetizable frame 10, which frame has a generally L-shaped armature member 12 pivotally mounted on a pin 14 provided in the frame, and adapted to move between the position shown and the FIG. 2 position such that member 12 contacts a pole piece 16 provided in an electromagnetic coil 18. The coil 18 is supported from the frame on a horizontally extending leg **10*a* and includes a delay tube (not shown) in which a magnetizable core is adapted to be moved from a lowered position to a raised position for purposes of energizing the armature 12 to pull it in, or downwardly against the pole piece 16 in response to overload currents in a series circuit that includes the terminals T1 and T2 of the breaker. Terminal T1 is connected through line L1 to one end of the electromagnetic coil 18 and the other end of this coil is connected by a line L2 to a movable contact member 20**.

Figure 3:
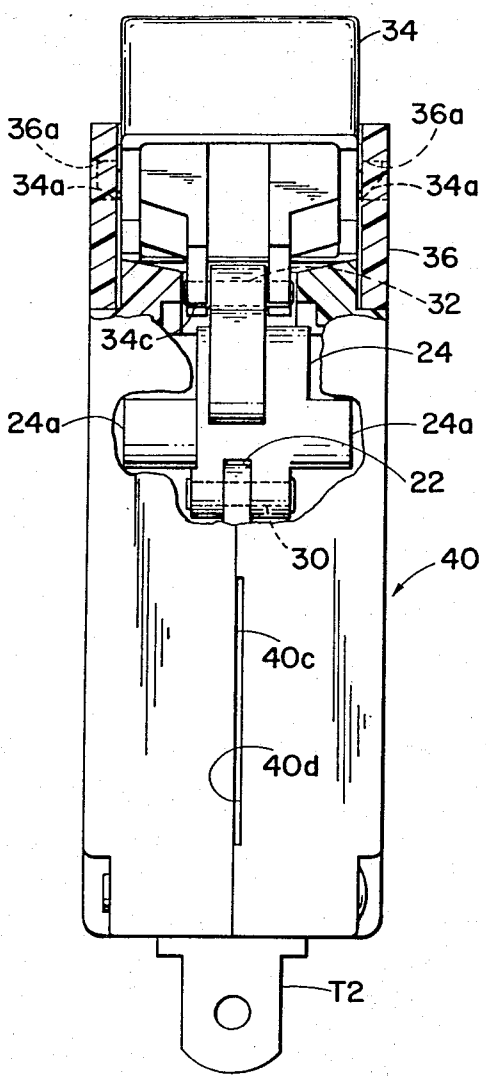
FIG. 3 is an end view of the circuit breaker and rocker bracket assembly illustrated in FIGS. 1 and 2 with portions of the bracket assembly and circuit breaker split case broken away.

The circuit breaker mechanism is of conventional configuration and includes a collapsible link 22 provided between the movable contact arm 20 and a pivotably mounted actuator link 24. The link is provided for rotation between the positions shown for it in FIGS. 1 and 2 on pivot pin 26 in the fixed frame 10. A torsion type return spring 28 is provided on the pivot pin 26 for urging the actuator link 24 from the position shown for it in FIG. 1 to that illustrated in FIG. 2. This spring 28 acts between the frame 10 and a boss on the link 24. FIG. 3 illustrates the actuator link 24 as having bosses **24*a*, provided on both its sides, and an opening in each of these bosses is adapted to interconnect one breaker to another breaker alongside it in the event that a multipole interconnected circuit breaker installation is required. Still with reference to the link 24, its lower end defines a cross opening for pivot pin 30, which pin carries one end portion of the collapsible link 22 referred to previously. The upper end of the actuator link 24 carries a cross pin 32, the ends of which cross pin 32 protude from the sides of the actuator link 24 and are adapted to be engaged by downwardly open slots provided for this purpose in a depending portion of a rocker actuator 34**.

Figure 5:
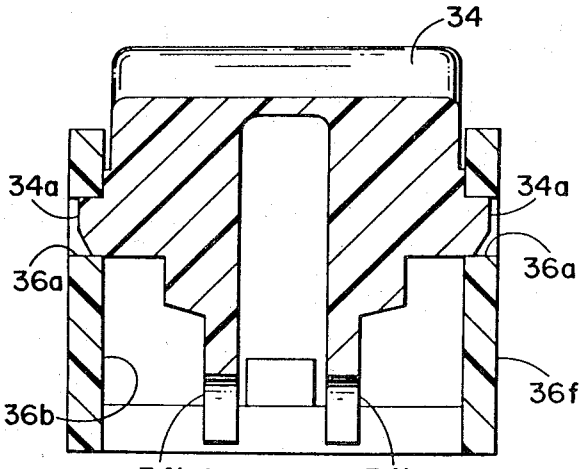
FIG. 5 is a sectional view taken on the line 5—5 of FIG. 2.

The rocker actuator 34 is formed from a one-piece thermoplastic material and has laterally projecting axle defining portions **34*a*, 34*a* which axle portions are adapted to be received in aligned openings 36*a*, 36*a*** provided for this purpose in an adapter plate 36 to be described. The adapter plate is secured to the circuit breaker case by suitable means and defines the pivot axis for the rocker 34. The canted lower sides of the axle defining portion 34*a* of the rocker 34 permit the rocker to be conveniently assembled in a rectangular opening 36*b* provided for it in the plate 36, which opening 36*b* is shown in FIGS. 1, 2 and 5. As so constructed and arranged the rocker 34 can be moved from its FIG. 1 to its FIG. 2 position, opening the breaker contacts described previously as a result of rotation of the actuator link 24 in the manner described above. The rocker 34 includes a conventionally configured concave external portion and an inner portion defining a depending bifurcated stem 34*b* such that depending slots 34*c*, 34*c* provided in the furcations of the stems 34*b*, 34*b* engage the ends of cross pin 32 to provide limited angular rotation of the actuator 24 in response to movement of the rocker between the limit positions shown for these elements in FIGS. 1 and 2. Return spring 28 acts on the actuator link 24 and serves to return the rocker to its OFF position unless acted upon by the internal circuit breaker mechanism itself. The reader is referred to our prior U.S. Pat. No. 4,347,488 for a more detailed description of the internal circuit breaker mechanism.

Turning now to a more detailed description of the adapter plate 36 it will be apparent that this plate 36 in cooperation with the rocker 34 provides an actuator bracket assembly that allows the circuit breaker mechanism to be manually actuated as a result of conventional rocking movement of a rocker type actuator. The adapter plate is of generally U-shaped configuration as best shown in FIGS. 1 and 2 and is integrally molded from thermoplastic material with integrally formed leg portions, one of which is of a suitable cross section to permit limited bending thereof relative to the other. As shown the left hand end portion of the adapter plate defines such a resilient leg portion 36*g*, which leg portion has an inturned lip at its lower end adapted to fit in a slot provided for this purpose in the end face of the circuit breaker case housing. The opposite leg end portion 36*c* is of sturdier cross sectional construction to provide a rigid support with the opposite end facing the circuit breaker housing 40. It too has a lip 36*d* adapted to fit into a slot provided for this purpose in the circuit breaker end face. Thus, at assembly the adapter plate 36 can be assembled first at the end with the thicker leg portion 36*c* and subsequently the resilient leg portion 36*g* can be bent outwardly relative to the first inserted leg portion 36*c* so as to provide a convenient method of assembly not requiring conventional fasteners or the like.

The front face of the circuit breaker housing defines an upstanding generally cylindrical boss 40*a*, which boss is adapted to fit within a portion of the through opening defining the generally rectangular cavity 36*b* for the rocker 34. It is noted that the upper end of the actuator link in the circuit breaker is provided within the confines of this boss 40*a*, and that the depending furcations 34*b*, 34*b* of the rocker 34 actually project into a slot normally provided for a toggle type actuator in the circuit breaker boss 40*a*.

Figure 4:
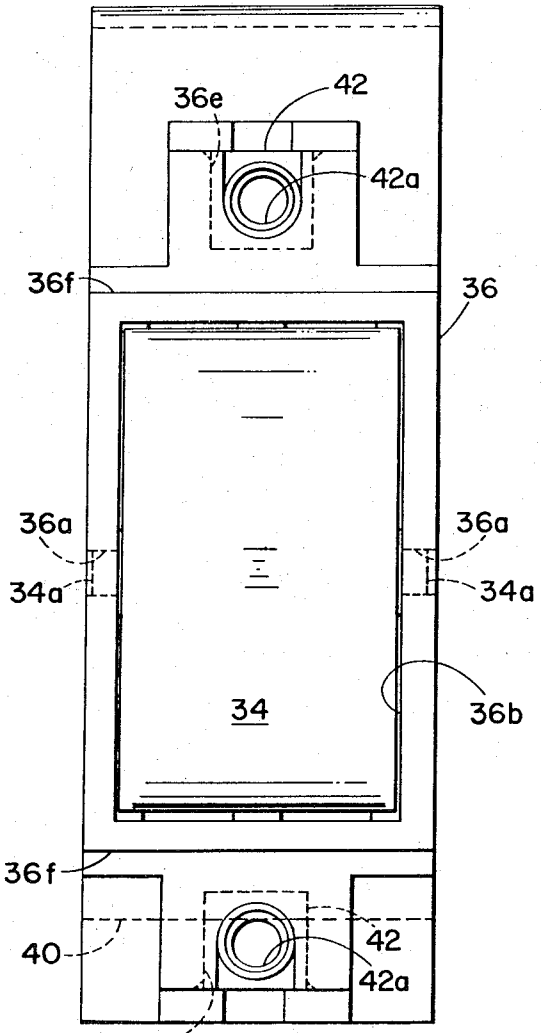
FIG. 4 is a top plan view of the assembly illustrated in FIGS. 1–3 inclusively.

The circuit breaker housing comprises half sections or shells best shown in FIG. 3 at 40*c* and 40*d*. The terminals T1 and T2 are conventionally provided in aligned slots provided for them in these half-sections or shells, and the front face of the circuit breaker housing 40 can be seen from the various views (FIGS. 1, 2 and 3) to be completely covered by the adapter plate 36 except for the through opening 36*b* where the rocker 34 is ultimately mounted. Since circuit breakers are generally mounted in panels by inserting the boss in the front face of the breaker housing into a panel opening so that metal threaded inserts normally provided in recesses 40*e* are conventionally utilized to mount the breaker other means must be provided to secure the bracket assembly of the present invention. The adapter plate portion 36 is provided with side opening recesses or cavities 36*e*, 36*e* to receive threaded metal inserts for this purpose. As best shown in FIG. 4 these recesses 36*e* open to the side (actually to the ends of bracket 36 in FIG. 4) and the inserts preferably have a rectangular base as indicated generally at 42 such that they can be conveniently inserted from both ends as seen in FIG. 4. This construction provides threaded openings 42*a* in these inserts such that conventional fasteners can be provided to mount the circuit breaker and its associated bracket assembly in a conventional panel opening. The spacing between these inserts is identical to that in the conventional circuit breaker without such a bracket assembly. However, the opening necessary in a panel to so mount the circuit breaker with a bracket assembly with the present invention must be provided with a rectangular opening to fit or to receive the peripherally extending boss 36*f* as best shown in FIG. 4.

As so constructed and arranged the bracket assembly can be assembled with the split case circuit breaker housing illustrated in the drawings by inserting the lips into the appropriate slots at the end faces of the circuit breaker housing. The resiliently deformable leg 36*g* can be sprung outwardly to assemble the bracket assembly in the position shown in FIGS. 1 and 2. Since the rocker 34 will have been already inserted into its position in the rectangular opening provided for it in the adapter plate the actuator link 24 should be positioned in the rocker OFF, breaker open, configuration of FIG. 2 so that the downwardly open slots in the furcations 34*b* of the stem portion of the rocker will engage the ends of the cross pin 32 as the adapter plate is so assembled with the case. It will be apparent that with the rocker in the position shown for it in FIG. 2 the slots in the stem 34*b* are oriented generally tangentially to the axis of rotation for the adapter plate during this assembly process. That is, with the lip 36*d* inserted in the slot provided for it at the right hand side of the case 40 the entire bracket assembly can be pivoted about this point with the result that deformation of the resilient leg 36*g* occurs at the same time as cross pin 32 is received in these slots of the rocker stem portion.

We claim:

1. The combination comprising a circuit breaker and an actuator bracket assembly adapted to permit manual actuation and or resetting of the breaker, said circuit breaker having a housing with opposite end faces and a front face, said front face having a raised boss adapted to fit a small panel opening, said boss defining a slot, said circuit breaker having a mechanism in the housing, said mechanism including a piovted actuator link having a free end portion provided in said slot, said link being pivotally provided for limited rotation on a fixed axis defined in the housing, and a cross pin provided parallel said link axis adjacent said link free end portion so that said cross pin also moves in said slot, said bracket assembly including a U-shaped adapter plate of one-piece plastic with a resilient integrally formed leg portion at one end and an opposite leg end portion which cooperates with said resilient leg portion to define a rearwardly open recess for receiving said circuit breaker front face as a result of bending said resilient leg portion, said plate leg portions defining inturned lips for entry in openings provided therefor in said circuit breaker end faces, said plate defining a generally rectangular outer boss to fit a larger panel opening than that adapted to accommodate said raised boss on the circuit breaker front face, said plate defining a rectangular recess inside said rectangular boss, and a rocker pivotably mounted in said rectangular recess, said rocker defining projecting integrally formed axle portions received in aligned openings provided for them in said rectangular boss defining said opening, said rocker having a depending yoke integrally formed therein and said yoke having laterally spaced legs that define downwardly open slots aligned with one another for receiving said cross pin end portions to provide pivotal motion of the actuator link generally opposite that of said rocker.

2. The combination of claim 1 wherein said U-shaped adapter plate also defines raised land portions adjacent the ends of said rectangular outer boss, said land portions defining stepped recesses which are spaced from one another a distance dictated by mounting holes located outside the large panel opening for so receiving the breaker and bracket assembly, and threaded metal insert slidably received in said stepped recesses to receive fasteners for mounting the breaker and bracket assembly.

3. The combination of claim 2 wherein said stepped recesses for said threaded inserts slidably receive said inserts in a lateral direction and generally perpendicular to the front face of the circuit breaker so assembled with said adapter plate.

* * * * *